United States Patent [19]

Gillessen et al.

[11] 4,365,244

[45] Dec. 21, 1982

[54] ARRANGEMENT FOR DISPLAYING IMAGES USING LIGHT EMITTING DIODES

[75] Inventors: Klaus Gillessen, Untergruppenbach; Heinz Rinderle, Heilbronn; Werner Schairer, Weinsberg; Martin Siegle, Weinstadt, all of Fed. Rep. of Germany; Christoph Malinowski, Bridgewater, N.J.

[73] Assignee: Licentia Patent-Verwaltungs-GmbH, Frankfurt am Main, Fed. Rep. of Germany

[21] Appl. No.: 247,596

[22] Filed: Mar. 25, 1981

[30] Foreign Application Priority Data

Apr. 3, 1980 [DE] Fed. Rep. of Germany ..... 3012995

[51] Int. Cl.[3] ..... G09G 3/32

[52] U.S. Cl. ..... 340/782; 313/500; 340/825.82

[58] Field of Search ..... 340/782, 825.82

[56] References Cited

U.S. PATENT DOCUMENTS 4,183,021 1/1980 Gerstner ..... 340/782 X

OTHER PUBLICATIONS

W. F. Arnold, LED Arrays Stack Uniformly, Electronics, Aug. 17, 1978, p. 129.

W. Rosenzweig, et al., A GaP Electroluminescent Diode Matrix Display System, IEEE Trans. on Electron Devices, vol. ED-18, No. 9, Sep. 1971, pp. 633-637.

*Primary Examiner*—David L. Trafton

*Attorney, Agent, or Firm*—Spencer & Kaye

[57] ABSTRACT

An arrangement for displaying images using light emitting diodes comprises two types of modules arranged to form a square matrix with the modules of one diagonal being of the first type and the remaining modules being of the second type, the first type having the same number of horizontal and column lines with each horizontal line connected to only one column line and the remaining crossing points having light emitting diodes connected between the horizontal and column lines and the second type having the same number of horizontal and column lines as the first type and light emitting diodes connected between horizontal and column lines at each crossing point.

3 Claims, 3 Drawing Figures

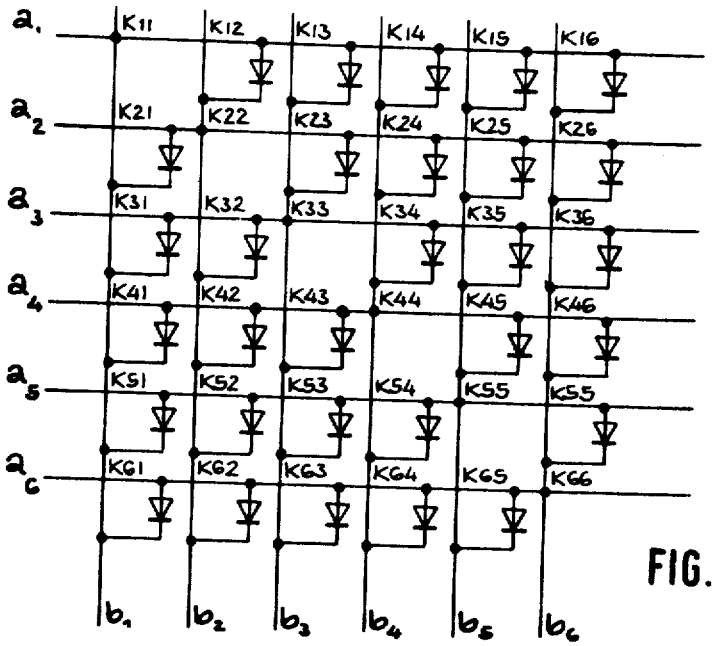
FIG. 1
FIG. 2
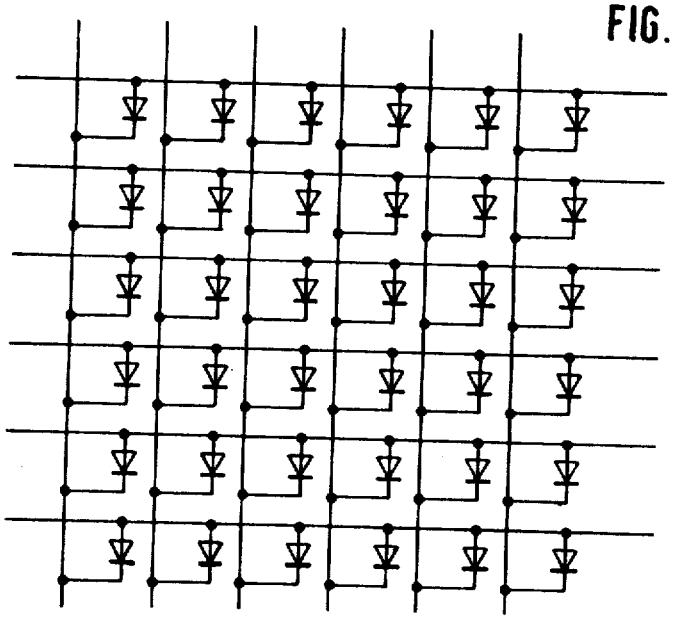

ARRANGEMENT FOR DISPLAYING IMAGES USING LIGHT EMITTING DIODES

BACKGROUND OF THE INVENTION

This invention relates to an arrangement for displaying images using light emitting diodes.

Displays for displaying images are implemented using light-emitting diodes (LED's) among others, today. In order to achieve a sufficiently high resolution, a very large number of picture elements (i.e. LED's for example) have to be used. In IEEE Transactions on Electron Devices, Vol. ED-26 (1979), pages 1182 to 1186 these display units are described by way of example and have between 6,144 and 38,400 LED's. In order to be able to control this large number of LED's separately, a correspondingly large number of supply lines is required. If wiring is like a matrix with horizontal and column lines it is possible for example to operate $n^2/4$ LED's with n supply lines (n being an even whole number). It is advisable, in order to provide economic manufacture, to implement displays with a very large number of LED's in modular construction, as described, for example, in "Aviation Week and Space Technology", June 18th 1979, pages 73 to 77. This shows how individual errors may be eliminated by exchanging a module.

SUMMARY OF THE INVENTION

It is an object of the invention to provide a display using LED's which comprises modules and is wired such that the number of supply lines required to control the display is kept as small as possible.

According to a first aspect of the invention there is provided an arrangement for displaying images using light emitting diodes comprising a square matrix of modules, a first type of module occupying one diagonal of said matrix and comprising the same number of horizontal lines and column lines, means for connecting each horizontal line to only a single column line and light emitting diodes connected between said horizontal lines and said column lines at all crossing points at which said horizontal lines and column lines are not interconnected and a second type of module occupying all the remaining places in said matrix having the same number of horizontal lines and column lines as said first type of module and light emitting diodes connected between said horizontal lines and said column lines at each crossing point.

According to a second aspect of the invention there is provided an arrangement for displaying images using light-emitting diodes comprising two types of modules, of which; a first type of module has a matrix-type wiring with the same number of horizontal and column lines, each horizontal line being connected to one and only one column line and with the exception of those crossing points at which the crossing horizontal and column lines are connected together, one light-emitting diode being arranged at each crossing point between a column line and a horizontal line, one connection of each said light-emitting diode being connected respectively with the horizontal line present at the crossing point and the other connection being connected in each case to the column line present at the crossing point; and a second type of module has matrix wiring with the same number of horizontal lines as column lines, which number is the same as in the first type of module; one light-emitting diode in each case being arranged at each crossing point between horizontal and column lines of the second type of module, one connection being connected in each case to the horizontal line present at the crossing point and the other connection being connected respectively to the column line present at the crossing point; the arrangement being formed like a square matrix comprising the two types of module with the modules of a diagonal of the matrix comprising modules of the first type and the remaining elements of the matrix comprising modules of the second type, each module of a horizontal line being connected to its adjacent module(s) in the horizontal line and each module of a column being connected to its adjacent module(s) in the column line such that each horizontal line and each column line of a module is connected respectively to the same horizontal or column line respectively of its adjacent module.

BRIEF DESCRIPTION OF THE DRAWINGS

The invention will now be described in greater detail, by way of example, with reference to the drawings, in which:

FIG. 1 is a circuit diagram of a first type of module for use in an arrangement in accordance with the invention;

FIG. 2 is a circuit diagram of a second type of module for use in one arrangement in accordance with the invention.

DESCRIPTION OF THE PREFERRED EMBODIMENT

Figure 3:
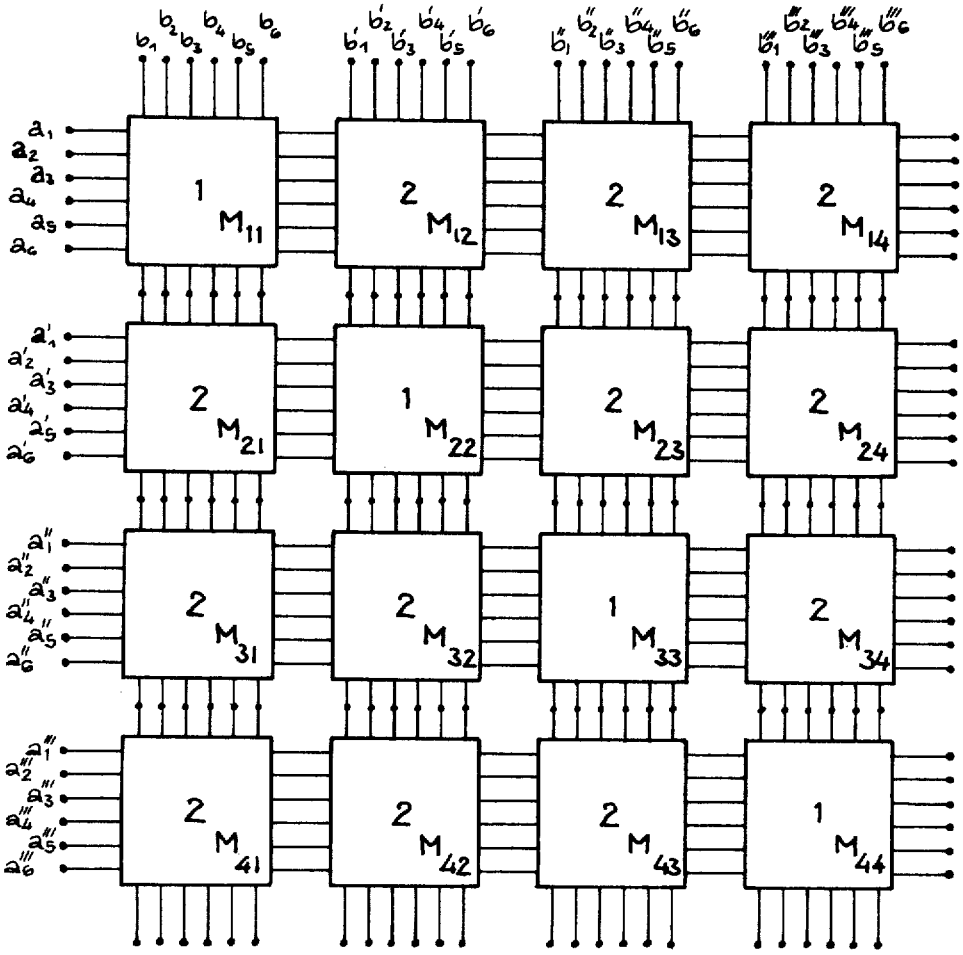
FIG. 3 is a block diagram of one form of arrangement in accordance with the invention.

The essence of the invention lies in the fact that the arrangement comprises two types of modules, the first module type being connected in accordance with a certain principle; the second module type being connected like a matrix; and the overall arrangement being connected according to the said certain principle. Referring now to the drawing, FIG. 1 shows the construction of the first module using the example of a module having 6 supply lines and $6\times5=30$ diodes. The six horizontal lines $a_1 \ldots a_6$ are used as supply lines. Besides these six horizontal lines $a_1 \ldots a_6$ in the first module type of FIG. 1 there are 6 column lines $b_1 \ldots b_6$ available so that the number of horizontal lines is equal to the number of column lines. As is apparent from FIG. 1 the first module type has a matrix like arrangement in which each horizontal line is connected to one and only one column line. In fact $a_1$ is connected to $b_1$, $a_2$ is connected to $b_2$, $a_3$ is connected to $b_3$, $a_4$ is connected to $b_4$, $a_5$ is connected to $b_5$, and $a_6$ is connected to $b_6$. In the first module type of FIG. 1, one light-emitting diode in each case is present at each crossing point between horizontal and column lines, at which crossing point, the crossing horizontal and column lines are not connected together, i.e. at all of the crossing points with the exception of the crossing points $K_{11}$, $K_{22}$, $K_{33}$, $K_{44}$, $K_{55}$ and $K_{66}$. On the other hand there are no LED's present at the crossing points $K_{11}$, $K_{22}$, $K_{33}$, $K_{44}$, $K_{55}$ and $K_{66}$ at which the crossing horizontal and column lines are connected together. One connection of the LED's of the first module type of FIG. 1 is connected respectively to the horizontal line present at the crossing point and the other connection respectively is connected to the column line present at the crossing point.

FIG. 2 shows the second module type which is constructed according to the known principle of matrix connection. The second module type has the same number of horizontal and column lines as the first module type. In the second module type, LED's are present at each crossing point between horizontal and column lines, one connection of these LED's being connected in each case to the horizontal line present at the crossing point and the other connection being connected respectively to the column line present at the crossing point. In the second module type, as FIG. 2 shows, there are not usually any horizontal lines connected to column lines. The second module type of FIG. 2 has six horizontal and six column lines and 36 diodes. FIG. 3 shows how the four modules of the first type and the 12 modules of the second type are connected together to form a display in this case having $4\times30+12\times36=552$ LED's. The 24 lines on the left serve to control this display. The display of FIG. 3 is connected together like a square ($4\times4$) matrix comprising the two types of module such that the four diagonal elements $M_{11}$, $M_{22}$, $M_{33}$ and $M_{44}$ of the matrix comprise modules of the first type 1 and the remaining twelve elements of the matrix comprise modules of the second type 2. The modules $M_{11}$ is connected to its adjacent module $M_{12}$ which is adjacent to it on the horizontal line such that each horizontal line $a_1$ to $a_6$ is connected to the same horizontal line of the adjacent module. Similarly the module $M_{11}$ is connected to its adjacent module $M_{21}$ adjacent to it down the column such that each column line $b_1$ to $b_6$ is connected to the same column line of the adjacent module. Similarly all of the modules of each line $M_{11}$ to $M_{14}$, $M_{21}$ to $M_{24}$, $M_{31}$ to $M_{34}$ and $M_{41}$ to $M_{44}$ and all of the modules of each column $M_{11}$ to $M_{41}$, $M_{12}$, to $M_{42}$, $M_{13}$ to $M_{43}$ and $M_{14}$ to $M_{44}$ are connected together.

According to the plan shown in FIG. 3 as many modules as desired may be connected together to form a display in similar manner. If n supply lines per module are assumed, then the module of the first type has $N_1=n\times(n-1)$ LED's and the module of the second type has $N_2=n^2$ LED's. If a display having m modules in each case in two dimensions is formed from these modules then this display has m modules of the first type and $m^2$-m modules of the second type. The overall number of LED's is therefore $N=m\times N_1+(m^2-m)\times N_2=m\times n\times(n-1)+m\times(m-1)\times n^2=m\times n\times(m\times n-1)mn.(mn-1)$. The number of supply lines of the overall display is $m\times n$ and the number of the diodes which can be controlled thereby is $m\times n\times(m\times n-1)$, corresponding to the overall number of LED's.

It will be understood that the above description of the present invention is susceptible to various modification changes and adaptations.

What is claimed is

1. An arrangement for displaying images using light-emitting diodes comprising two types of modules, of which a first type of module has a matrix-type wiring with the same number of horizontal and columns lines, each horizontal line being connected to one and only one column line and, with the exception of those crossing points at which the crossing horizontal and column lines are connected together, one light-emitting diode being arranged at each crossing point between a column line and a horizontal line, one connection of each said light-emitting diode being connected respectively with the horizontal line present at the crossing point and the other connection being connected in each case to the column line present at the crossing point; and a second type of module has matrix wiring with the same number of horizontal lines as column lines, which number is the same as in the first type of module; one light-emitting diode in each case being arranged at each crossing point between horizontal and column lines of the second type of module, one connection being connected in each case to the horizontal line present at the crossing point and the other connection being connected respectively to the column line present at the crossing point; the arrangement being formed like a square matrix comprising the two types of module with the modules of a diagonal of the matrix comprising modules of the first type and the remaining elements of the matrix comprising modules of the second type, each module of a horizontal line being connected to its adjacent module(s) in the horizontal line and each module of a column being connected to its adjacent module(s) in the column line such that each horizontal line and each column line of a module is connected respectively to the same horizontal or column line respectively if its adjacent module.

2. An arrangement as defined in claim 1, wherein the light-emitting diodes of a horizontal line in a matrix have the same spacing from each other and that the light emitting diodes of a column line in a matrix also have the same spacing from each other.

3. An arrangement for displaying images using light emitting diodes comprising a square matrix of modules, a first type of module occupying one diagonal of said matrix and comprising the same number of horizontal lines and column lines, means for connecting each horizontal line to only a single column line and light emitting diodes connected between said horizontal lines and said column lines at all crossing points at which said horizontal lines and column lines are not interconnected and a second type of module occupying all the remaining places in said matrix having the same number of horizontal lines and column lines as said first type of module and light emitting diodes connected between said horizontal lines and said column lines at each crossing point.

* * * * *